US005249198A

United States Patent [19]

Matsuoka

[11] Patent Number: 5,249,198

[45] Date of Patent: Sep. 28, 1993

[54] INDUCTION FURNACE HAVING AN OBLIQUE COIL NUMBER

[75] Inventor: Toshio Matsuoka, Ehime, Japan

[73] Assignee: Sumitomo Heavy Industries, Ltd., Tokyo, Japan

[21] Appl. No.: 804,685

[22] Filed: Dec. 11, 1991

[51] Int. Cl.[5] ..... H05B 6/22

[52] U.S. Cl. ..... 373/152; 373/151; 373/154; 373/156

[58] Field of Search ..... 373/138, 139, 146, 151, 373/152, 156, 154

[56] References Cited

U.S. PATENT DOCUMENTS

| | | | |
|---|---|---|---|
| 1,748,706 | 2/1930 | Esmarch | 373/152 |
| 1,763,200 | 6/1930 | Tjoflat | 373/152 |
| 1,778,398 | 10/1930 | Northrup | 373/145 |
| 1,872,990 | 8/1932 | Linnhoff | 373/152 |
| 2,463,864 | 8/1969 | Tama | 373/143 |
| 4,060,692 | 11/1977 | Naastepad et al. | 373/151 |
| 4,610,017 | 9/1986 | Perrier de la Bathie et al. | 373/156 |

FOREIGN PATENT DOCUMENTS

| | | |
|---|---|---|
| 619807 | 10/1935 | Fed. Rep. of Germany . |
| 1319891 | 4/1962 | France . |
| 2316828 | 1/1977 | France . |
| 64-558 | 1/1989 | Japan . |

*Primary Examiner*—Bruce A. Reynolds
*Assistant Examiner*—Tu Hoang
*Attorney, Agent, or Firm*—Burns, Doane, Swecker & Mathis

[57] ABSTRACT

In an induction furnace including a crucible having a crucible center axis and a coil member wound around the crucible, the coil member has a coil center axis oblique to the crucible center axis at an acute angle between 3° and 10°. The coil member is consequently wound around the crucible so that each winding of the coil member is inclined to the crucible center axis at an angle except 90° and has a highest position and a lowest position on a crucible side wall of the crucible. An inlet port and an outlet port of the crucible are located at positions adjacent to the highest and the lowest positions of the windings, respectively.

15 Claims, 2 Drawing Sheets

INDUCTION FURNACE HAVING AN OBLIQUE COIL NUMBER

BACKGROUND OF THE INVENTION

This invention relates to an induction furnace for use in melting or processing a material, such as used dry batteries (abbreviated to UDB), electric arc furnace dust (EFD), activated sludge burned ashes (ASA), ashes of garbage incineration, and the like. It is to be noted that such a material to be processed will be simply called a material hereinunder.

In general, an induction furnace of the type described comprises a crucible for charging or dumping a material to be processed and a coil member wound around the crucible. An a.c. exciting current of a low frequency, for example, 50–60 Hz is caused to flow from an a.c. current source through the coil member to induce an electromagnetic flux within the crucible. As a result, an eddy-current flows in the material which is charged into the crucible through an inlet port. The material is heated by the eddy-current within the crucible. Thus, induction heating is carried out in the crucible. In this event, the material is agitated to be fused and is sent through an outlet port in the form of a slag or a molten bath.

In the induction furnace for the present purpose, it is preferable that each of charged materials is heated from the inlet port to the outlet port for a uniform retention time. Otherwise, a uniform slag and metal product can not be ejected through the outlet port.

However, it has been pointed out that such a retention time is often variable for the materials in the conventional induction furnace.

In order to prevent such variation of the retention time, proposal has been made in Japanese Utility Model Publication No. Syo 64-558, namely, 558/1989 about an induction furnace comprising a crucible which has a crucible center axis and an axial symmetrical configuration with respect to the crucible center axis. Specifically, the crucible is outlined by an inverted frustum contour, namely, an inverted circular truncated contour. An induction coil is wound around the crucible so that the crucible center axis becomes a winding axis. In addition, it is assumed that the inlet and the outlet ports are located on both sides of the crucible center axis and are adjacent to the crucible side wall as compared with the crucible center axis. Under the circumstances, when the material is charged into the crucible through the inlet port adjacent to the crucible side wall, a temperature of the slag bath is locally lowered at an area near to the inlet port. As a result, a temperature of the crucible side wall is also locally lowered at a position adjacent to the low temperature area of the slag bath. The charged material is liable to be adhered to such a low temperature position of the crucible side wall.

SUMMARY OF THE INVENTION

It is an object of this invention to provide an induction furnace which is capable of making a retention time of each material long enough to uniformly melt each material.

It is another object of this invention to provide an induction furnace of the type described, which is capable of preventing a material from being adhered to a crucible side wall.

An induction furnace to which this invention is applicable comprises a crucible which has a crucible center axis and an axial symmetrical configuration with respect to the crucible center axis and an induction coil wound around the crucible. The crucible has a crucible bottom, a crucible side wall contiguous to the crucible bottom, and a crucible cover covered on the crucible side wall to define an internal space together with the crucible bottom and the crucible side wall. The crucible center axis is extended through the crucible bottom and the crucible cover. According to this invention, the coil member is wound around the crucible side wall so that the coil member has a hypothetical coil center axis oblique with respect to the crucible center axis at an acute angle.

DESCRIPTION OF THE PREFERRED EMBODIMENT

Figure 1:
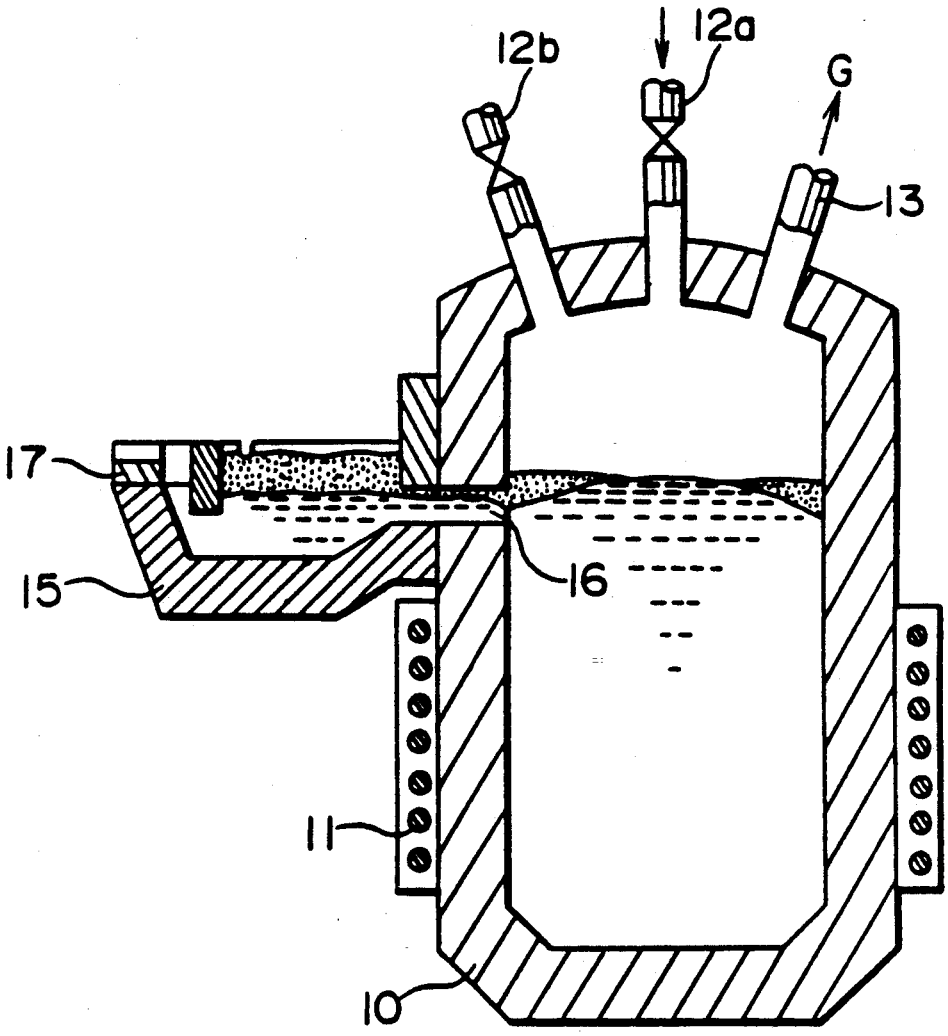
FIG. 1 PRIOR ART
FIG. 1 is a sectional view of a conventional induction furnace.

Referring to FIG. 1, description will be made about a conventional induction furnace for a better understanding of this invention. The illustrated induction furnace comprises a cylindrical crucible 10 which has a cylinder center axis, a crucible bottom, a cylindrical side wall standing upright from the crucible bottom, a crucible cover mounted on the cylindrical side wall to define an internal space together with the crucible bottom and the cylindrical side wall. The cylindrical side wall is wound by a coil member 11 which has a coil center axis substantially coincident with the cylinder center axis. In other words, the coil member 11 is wound around the cylindrical side wall so that the coil member 11 is perpendicular to the cylindrical center axis. As shown in FIG. 1, the illustrated coil member 11 is wound at a lower portion of the crucible 10.

On the crucible cover, a main inlet port **12*a*, a supplementary inlet port 12*b*, and an exhaust port 13 are formed to charge or dump a material, to supplementarily charge another material, and to exhaust an inner gas, respectively. The illustrated main inlet port 12*a* is vertically extended from the crucible cover and substantially coincident with the crucible center axis. The supplementary inlet port 12*b* and the exhaust port 13 are located on both sides of the main inlet port 12*a* on the crucible cover with both the supplementary inlet port 12*b* and the exhaust port 13 inclined relative to the main inlet port 12*a***.

To an upper portion of the crucible side wall, a basin 15 is attached through a tap hole or an outlet port 16 and is associated with the inner space of the crucible 10. As illustrated in FIG. 1, the basin 15 is located above the coil member 11. A slag bath and a metal bath are held in the crucible 10 as a result of induction heating and thereafter flows out of the crucible 10 into the basin 15 through the outlet port 16. The slag bath and the metal bath are discharged from the basin 15 through a weir 17 out of the basin 15.

More specifically, the materials which may be of a metal or include a metal compound are successively charged through the inlet port **12*a* into the crucible 10, with an a.c. exciting current caused to flow through the coil member 11**.

The material is molten and reduced into metal and/or slag baths. The slag bath floats on the metal bath, as depicted at dotted portions in FIG. 1. In this event, a gaseous material is exhausted through the exhaust port 13 into an exhaust gas recovery and treatment apparatus (not shown).

A level of the slag bath increases in the crucible as a reactive material increases in the slag bath. With an increase of the level of the slag bath, the molten material flows out of the crucible 10 through the outlet port 16 into the basin 15 because the crucible 10 is associated with the basin 15. This shows that the slag and the metal baths partially flow out of the crucible 10 into the basin 15. Subsequently, the molten material is continuously discharged from the basin 15 through the weir 17 with the slag bath interrupted in the basin 15, as illustrated in FIG. 1.

In the example being illustrated, the material is successively charged at the center of the crucible 10 and the molten material is successively discharged through the outlet port 16 on the crucible side wall. In this case, the charged material is moved along an upper region of the slag bath towards a peripheral portion of the slag bath by a swirling-up motion which results from an electromagnetic field. Thereafter, the charged material is submerged downwards of the metal bath.

With this structure, a retention time is defined in connection with the slag bath, as known in the art. Namely, the retention time is determined by a volume of the slag bath and a feed rate of the material and is irregularly variable. The material which moves directly to the outlet port 16 reaches the outlet port 16 before it is melted in the crucible 10. This means that the retention time becomes very short for such a material and that a short path takes place in the slag bath. In this case, the material is not preferably processed in the crucible 10, as pointed out in the preamble of the instant specification.

Figure 2:
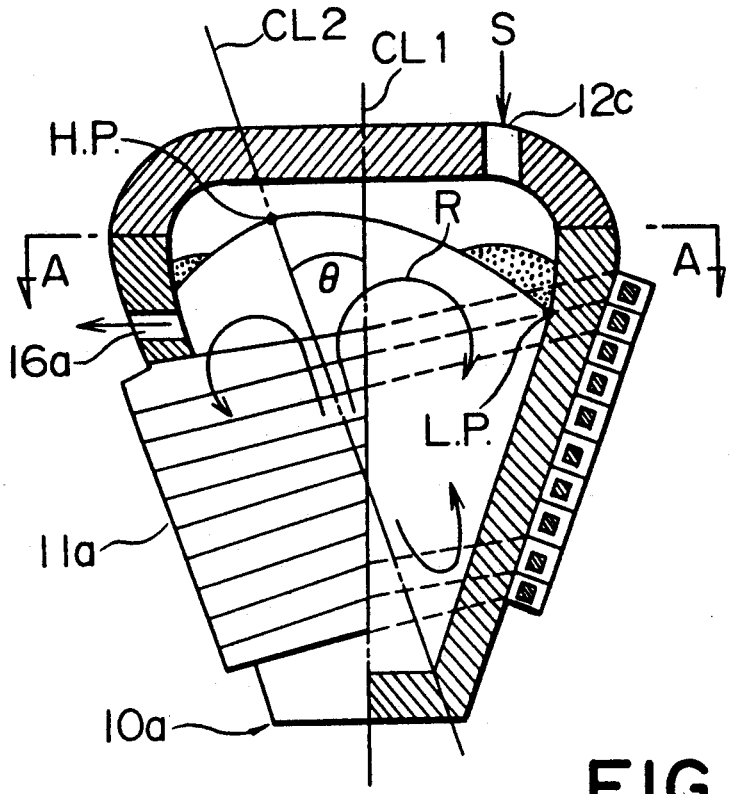
FIG. 2 is a partial sectional view of an induction furnace according to a preferred embodiment of this invention.
Figure 3:
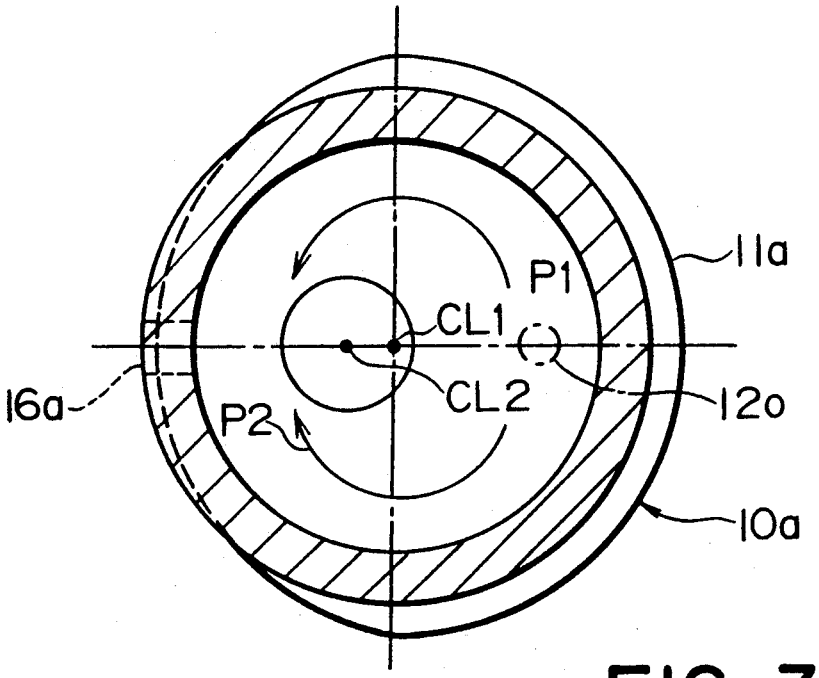
FIG. 3 is a cross sectional view of the induction furnace illustrated in FIG. 2.

Referring to FIGS. 2 and 3, an induction furnace according to a preferred embodiment of this invention comprises a crucible 10*a* of a circular truncated or frustum configuration. Specifically, the crucible 10*a* has a crucible bottom, a crucible side wall contiguous to the crucible bottom, and a crucible cover mounted on the crucible side wall. The crucible side wall has a lower portion adjacent to the crucible bottom and an upper portion wider than the lower portion in section, as shown in FIG. 2. At any rate, the illustrated crucible 10*a* has an axial symmetrical configuration with respect to the crucible center axis CL1.

A coil member 11*a* is obliquely wound around the crucible side wall so that the coil member has a coil center axis CL2 which is oblique with respect to the crucible center axis CL1. The coil center axis CL2 is inclined to the crucible center axis CL1 at an angle $\theta$ between 3° and 10°. Preferably, the acute angle $\theta$ is equal to 4°.

More particularly, the coil member 11*a* is composed of a plurality of windings or turns which are oblique with respect to the crucible center axis CL1 and each of which has the highest position and the lowest position on the crucible side wall.

On the cover of the crucible 10*a*, an inlet port 12*c* is formed to successively charge materials S into the crucible 10*a* therethrough. In the illustrated example, the inlet port 12*c* is displaced or eccentrical relative to the crucible center axis CL1, as shown in FIGS. 2 and 3. It is to be noted in FIGS. 2 and 3 that the inlet port 12*c* is adjacent to the highest positions of the windings of the coil member 11*a* and is remote from the lowest positions of the coil. A tap hole or an outlet port 16*a* is formed on the upper portion of the crucible side wall and is adjacent to the lowest positions of the coil, as best shown in FIG. 2.

Moreover, the inlet port 12*c*, the outlet port 16*a*, and the crucible center axis CL1 are arranged in a line, as illustrated in FIG. 3. In other words, the outlet port 16*a* is placed along a straight line extended through both the inlet port 12*c* and the crucible center axis CL1 and is located on an opposite side of the inlet port 12*c* with respect to the crucible center axis CL1. The outlet port 16*a* is coupled to a basin (not shown in this figure), like in FIG. 2 while an exhaust port is also formed on the crucible cover to exhaust the gas from the crucible 10*a*, like in FIG. 1, although such an exhaust port is omitted from FIGS. 2 and 3.

Herein, it is assumed that the exciting current is caused to flow through the coil member 11*a* from an a.c. current source (not shown) and that an eddy current flows in the metal bath in a known manner. In this event, the metal bath is moved within the crucible 10*a* swirling up along the crucible center axis CL1 in FIG. 2. The molten metal is moved or directed towards the crucible side wall when it reaches the metal bath surface and the crucible bottom and the slag floating on the metal bath moves in such a way that the lower part of the slag moves in the radial direction along with the metal surface movement while the upper part of the slag moves countercurrently to the lower part. Thereafter, the molten metal is submerged downwards and ascended upwards to form a descending and an ascending flow along the crucible side wall, as depicted at an arrow R. The descending and the ascending flows are joined together with each other to form a flow which is directed towards the coil center axis CL2. Such flows are collected from every direction around the coil center axis CL2 to be joined together on the coil center axis CL2 and are thereafter moved upwards and downwards.

In any event, such upward and downward flows brings about agitating operation of the metal bath which is largely dependent on electromagnetic force. In other words, the upward and the downward flows serve to bring about an upward agitating operation and a downward agitating operation, respectively. In the illustrated example, it has been confirmed according to the inventor's experimental studies that the upward agitating operation becomes intense in comparison with the downward agitating operation when the configuration of the furnace is designed as FIGS. 2 and 3.

Furthermore, the molten metal flows around the coil center axis CL2, as depicted at arrows P1 and P2, on the metal bath surface. This is because the highest point of the molten metal surface is located at the point H.P. which causes first the potential flow to occur from the highest point to the lowest point L.P. of the molten metal surface and then the stagnation of the molten metal and the slag results in the counter flow of the melts to the outlet port 16*a*, as depicted at arrows P1 and P2 in FIG. 3. More specifically, the metal bath exhibits the metal bath surface convex upwards of FIG. 2 and has the maximum height peak along the coil center axis CL2. In other words, the coil center axis CL2 intersects the slag bath surface at the highest position (H.P.). This shows that a position of the maximum height peak depends on the angle $\theta$ between the crucible center axis CL1 and the coil center axis CL2. Stated otherwise, the maximum height peak can be determined by an oblique angle of the coil member 11*a*.

When the maximum height peak is eccentric relative to the crucible center axis CL1, the molten material flows from the maximum height peak to a lower portion of the metal bath surface. In other words, a gradient takes place between the maximum height peak and the lower portion. In the illustrated example, a lowest position of the metal bath surface is adjacent to the outlet port 16*a* and is lower than a level of the slag bath surface at a position right under the inlet port 12*c*. Therefore, the gradient is formed between the position right under the inlet port 12*c* and the outlet port 16*a* around the maximum height peak.

As a result, bifurcated flows depicted at P1 and P2 in FIG. 3 appear on the slag bath surface and are sent from the position right under the inlet port 12*c* to the outlet port 16*a*. From this fact, it is readily understood that each material charged through the inlet port 12*a* is bifurcated at the position right under the inlet port 12*a* and is caused to slowly flow along the crucible side wall towards the outlet port 16*a*. Each charged material is subjected to the agitating operation before it reaches the outlet port 16*a*. Consequently, each charged material is submerged into the metal bath.

With this structure, a decrease of a temperature which might occur on charge of each material becomes small because the position right under the inlet port 12*a* is very close to the highest portion of the coil. Accordingly, it is possible to avoid adhesion of each object to the crucible side wall.

While this invention has thus far been described in conjunction with a preferred embodiment thereof, it will readily be possible for those skilled in the art to put this invention into practice in various other manners. For example, the crucible may have a cylindrical configuration, like in FIG. 1.

What is claimed is:

1. An induction furnace for use in processing industrial wastes of metals to melt said industrial wastes as a slag on a metal bath, said induction furnace comprising:

a crucible which has an internal space, a crucible center axis, and an axial symmetrical configuration with respect to said crucible center axis and which has a crucible bottom portion closed, a crucible upper portion opened, and a side wall contiguous to both of said crucible bottom portion and said crucible upper portion, and a crucible cover mounted on said crucible upper portion, said side wall having a circular truncated configuration such that said crucible upper portion is wider in area than said crucible bottom portion, said crucible center axis being extended through said crucible bottom portion and said crucible cover; and an induction coil member wound around said crucible side wall so that said induction coil member has a coil center axis which is oblique, at an acute angle, with respect to said crucible center axis.

2. An induction furnace as claimed in claim 1, wherein said crucible cover further includes:

an inlet port for introducing said industrial wastes into said internal space, and said side wall further includes:

an outlet port for removing metal from said internal space.

3. An induction furnace as claimed in claim 1, wherein said inlet port is located on a straight line intersecting both of said crucible center axis and said coil center axis while said outlet port is located along said straight line on a side of said crucible center axis opposite said inlet port.

4. An induction furnace as claimed in claim 1, wherein said induction coil member further comprises:

a plurality of coil windings each of which is oblique with respect to said crucible center axis, one of said coil windings being adjacent said crucible cover and having a first position and a second position both of which are adjacent to said crucible cover on said side wall, said first position of said one coil winding being closer to said crucible cover than said second position with said inlet port being located on said crucible cover closer to said first position than to said second position, and with said outlet port being formed on said side wall at a wall position closer to said second position than to said first position.

5. An induction furnace as claimed in claim 1, wherein said acute angle is between 3 and 10 degrees.

6. An induction furnace as claimed in claim 5, wherein said acute angle is 4 degrees.

7. An induction furnace for melting metals as slag on a metal bath, said induction furnace comprising:

a crucible having a crucible side wall, a closed crucible bottom portion and an open crucible upper portion, said crucible being formed with an internal space having a crucible center axis about which said crucible is symmetrical, and said crucible being shaped in a circular truncated configuration which renders a surface area of said crucible upper portion greater than a surface area of said crucible bottom portion;

a crucible cover mounted on said crucible upper portion such that said crucible center axis extends through said crucible bottom portion and said crucible cover; and an induction coil member wound about said crucible side wall, said induction coil member having a coil center axis which is oblique, at an acute angle, with respect to said crucible center axis.

8. An induction furnace as claimed in claim 7, wherein said crucible cover further includes:

an inlet port for introducing said industrial wastes into said internal space, and wherein said side wall further includes:

an outlet port for removing metal from said internal space.

9. An induction furnace as claimed in claim 7, wherein said inlet port is located on a straight line intersecting both of said crucible center axis and said coil center axis while said outlet port is located along said straight line on a side of said crucible center axis opposite said inlet port.

10. An induction furnace as claimed in claim 7, wherein said induction coil member further comprises:

a plurality of coil windings each of which is oblique with respect to said crucible center axis, one of said coil windings being adjacent said crucible cover and having a first position and a second position both of which are adjacent to said crucible cover on said side wall, said first position of said one coil winding being closer to said crucible cover than said second position with said inlet port being located on said crucible cover closer to said first position than to said second position, and with said outlet port being formed on said side wall at a wall position closer to said second position than to said first position.

11. An induction furnace as claimed in claim 7, wherein said acute angle is between 3 and 10 degrees.

12. An induction furnace as claimed in claim 11, wherein said acute angle is 4 degrees.

13. An induction furnace as claimed in claim 7, wherein said coil center axis of said induction coil member is formed at an angle with respect to said crucible center axis, which coil center axis passes through a location of a maximum height of a metal bath in said internal space.

14. An induction furnace as claimed in claim 8, wherein said coil center axis of said induction coil member is formed at an angle with respect to said crucible center axis, which coil center axis passes through a location of a maximum height of a metal bath in said induction furnace.

15. An induction furnace as claimed in claim 14, wherein said location of said maximum height is located eccentrically with respect to said crucible center axis.

* * * * *